US010898908B2

(12) United States Patent
Kington et al.

(10) Patent No.: US 10,898,908 B2
(45) Date of Patent: Jan. 26, 2021

(54) SPRAY HEADS

(71) Applicant: KOHLER MIRA LIMITED, Cheltenham (GB)

(72) Inventors: Gary Kington, Cheltenham (GB); Simon Browning, Cheltenham (GB)

(73) Assignee: KOHLER MIRA LIMITED

( * ) Notice: Subject to any disclaimer, the term of this patent is extended or adjusted under 35 U.S.C. 154(b) by 58 days.

(21) Appl. No.: 16/098,791

(22) PCT Filed: Mar. 10, 2017

(86) PCT No.: PCT/GB2017/050643

§ 371 (c)(1),
(2) Date: Nov. 2, 2018

(87) PCT Pub. No.: WO2017/191427

PCT Pub. Date: Nov. 9, 2017

(65) Prior Publication Data

US 2019/0126295 A1 May 2, 2019

(30) Foreign Application Priority Data

May 4, 2016 (GB) ..... 1607824.8

(51) Int. Cl.
*B05B 1/16* (2006.01)
*B05B 1/18* (2006.01)

(52) U.S. Cl.
CPC . *B05B 1/16* (2013.01); *B05B 1/18* (2013.01)

(58) Field of Classification Search
CPC ..... B05B 1/16; B05B 1/18
USPC ..... 239/442, 443, 556–562
See application file for complete search history.

(56) References Cited

U.S. PATENT DOCUMENTS

2013/0239320 A1* 9/2013 Aihara ..... B05B 1/1609 4/615
2017/0136473 A1 5/2017 Yu

FOREIGN PATENT DOCUMENTS

| | | |
|---|---|---|
| CN | 204769215 | 11/2015 |
| DE | 202010005256 | 5/2011 |
| EP | 2711084 | 3/2014 |
| WO | WO2015/075256 | 5/2015 |
| WO | WO2015/196618 | 12/2015 |

OTHER PUBLICATIONS

International Search Report and Written Opinion in PCT/GB2017/050643, dated Jun. 9, 2017, 8 pgs.
Search Report in GB 1607824.8, dated Oct. 27, 2016, 3 pages.
Second CN Office Action CN Appl No. 201780018162.X dated Oct. 16, 2020; 8 pages.

* cited by examiner

*Primary Examiner* — Christopher S Kim
(74) *Attorney, Agent, or Firm* — Foley & Lardner LLP

(57) ABSTRACT

This invention provides a spray head (110*b*) for a shower comprising a spray plate (124) having an apertured portion (124*a*) and an actuator portion (124*b*). The apertured portion has (124*a*) apertures (126) therein. The actuator portion (124*b*) is configured to be actuated by a user to change a spray pattern provided by the apertures of the apertured portion.

14 Claims, 3 Drawing Sheets

SPRAY HEADS

CROSS-REFERENCE TO RELATED PATENT APPLICATIONS

This application is a U.S. National Stage of International Application No. PCT/GB2017/050643, filed Mar. 10, 2017, which claims priority to and the benefit of United Kingdom Patent Application 1607824.8, filed May 4, 2016, each of which is incorporated herein by reference in its entirety.

BACKGROUND

This invention relates to spray head and more especially to adjustable spray heads for use in a shower.

Prior art adjustable spray heads often have an aperture spray plate rotatable on the body of the spray head to change the spray pattern of water flowing from the apertures in the spray plate. These spray heads can be difficult to use, especially for elderly or disabled users with reduced manual dexterity and/or eyesight.

There is therefore a need for a spray head which provides improved ease of adjustment.

SUMMARY

According to one aspect the present invention provides a spray head for a shower comprising a spray plate having an apertured portion and an actuator portion, the apertured portion having apertures therein and the actuator portion being configured to be depressed by a user to change a spray pattern provided by the apertures of the apertured portion.

The spray head may be part of a shower handset, or may be a fixed ceiling- or wall-mounted shower head.

It may be that the actuator portion is configured to operate a spray control mechanism located behind the spray plate to control fluid flow to the apertured portion for changing the spray pattern.

It may be that the spray control mechanism includes a flow plate located behind the spray plate and having holes therein aligned with the apertures in the apertured portion of the spray plate.

It may be that the spray control mechanism is configured to be activated by depression of the actuator portion of the spray plate.

It may be that the spray control mechanism includes a diverter operable in response to depression of the actuator portion of the spray plate to change the spay pattern.

It may be that the actuator portion is integral with, the apertured portion of the spray plate.

It may be that the spray plate is made of a flexible material.

It may be that the actuator portion is arranged to allow switching of the spray pattern each time the actuator portion is depressed.

According to another aspect, the invention provides a method of adjusting the spray pattern of fluid from a spray head comprising a spray plate having an apertured portion and a depressible actuator portion, the method comprising depressing the depressible actuator portion of the spray plate.

BRIEF DESCRIPTION OF THE DRAWINGS

There now follows by way of example only a detailed description of embodiments of the present invention with reference to the accompanying drawings in which.

DETAILED DESCRIPTION

Figure 1:
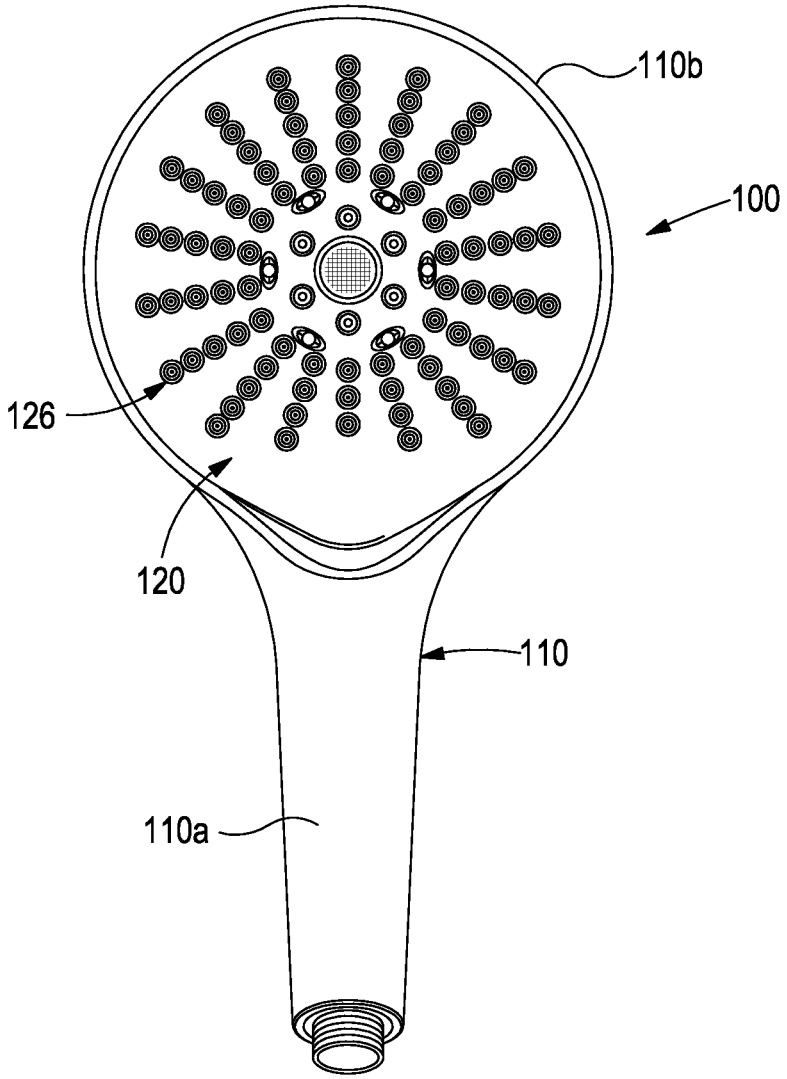
FIG. 1 shows a front view of a shower handset according to an embodiment.

Referring to the drawings, a shower handset 100 is shown. The shower handset 100 comprises a hollow body 110 having a grip portion 110*a* and a head portion 110*b* and a spray assembly 120. In this embodiment, the spray assembly 120 has a stem portion 120*a* and a spray portion 120*b*. The stem portion 120 is received within the grip portion 110*a* of the body 110 and has a connector 122 at a first end that extends from the grip portion 110*a* and has a thread 122*a* for attaching a water supply such as a flexible hose (not shown). The spray portion 120*b* is provided at a second end of the stem portion 120*a* and is located in the head portion 110*b* of the body 110. The stem portion 120*a* delivers water to the spray portion 120*b*. In other embodiments (not shown), the stem portion 120*a* may be omitted and the grip portion 110*a* may be connected to the water supply and deliver water to the spray portion 120*b*.

The spray portion 120*b* includes a spray plate 124 having an apertured portion 124*a* and an actuator portion 124*b*. The apertured portion 124*a* has a plurality of apertures 126 which define at least two spray patterns.

The spray portion 120*b* further includes a spray control mechanism 128 located behind the spray plate 124 and operable by the actuator portion 124*b* to control selectively the supply of water to the apertures 126 in the spray plate 124.

The spray control mechanism 128 includes a flow plate 130 and a switch member 132. The switch member 132 is pivotally connected to the flow plate 130. The spray plate 124 overlies and conceals the flow plate 130 and switch member 132.

The flow plate 130 has a plurality of holes 134 aligned with the apertures 126 in the spray plate 124. The spray plate 124 and flow plate 130 are configured to confine fluid flow through each hole 134 to the aligned aperture 126 and prevent fluid leaking between the spray plate 124 and flow plate 130, For example, the spray plate 124 and flow plate 130 may be configured to seal around each hole 134 and aligned aperture 126.

in this embodiment, the apertures 126 in the spray plate 124 and holes 134 in the flow plate 130 include a central aperture 126*a*/hole 134*a* to provide a first spray pattern, an inner array of apertures 126*b*/holes 134*b* surrounding the central aperture 126*a*/hole 134*a* to provide a second spray pattern, an intermediate array of apertures 126*c*/holes 134*c* surrounding the inner array to provide a third spray pattern, and an outer array of apertures 126*d*/holes 134*d* surrounding the intermediate array to provide a fourth spray pattern. The central hole 134*a* in the flow plate 130 may be provided with a mesh to produce a fine spray pattern.

The number, shape and configuration of the apertures 126/holes 134 may be changed to provide any number and/or combination, of spray patterns in other embodiments. Different spray patterns may use entirely separate sets of apertures 126/holes 134. Alternatively, the same apertures 126/holes 134 may be used for more than one spray pattern. For example, in some embodiments, fluid flow through the central aperture 126*a*/134*a* may be present in all spray patterns, and/or one spray pattern may use all apertures 126/holes 134.

The actuator portion 124*b* is located on the circumference of the spray plate 124 and forms a curved protrusion therefrom. The actuator portion 124*b* may be aligned with the grip portion 110*a* of the body 110. This may facilitate location of the actuator portion 124*b* by a user with impaired vision. Alternatively or additionally, the surface of the spray plate 124 may have a different texture in the region of the actuator portion 124*b* to facilitate its location by a user.

Figure 2:
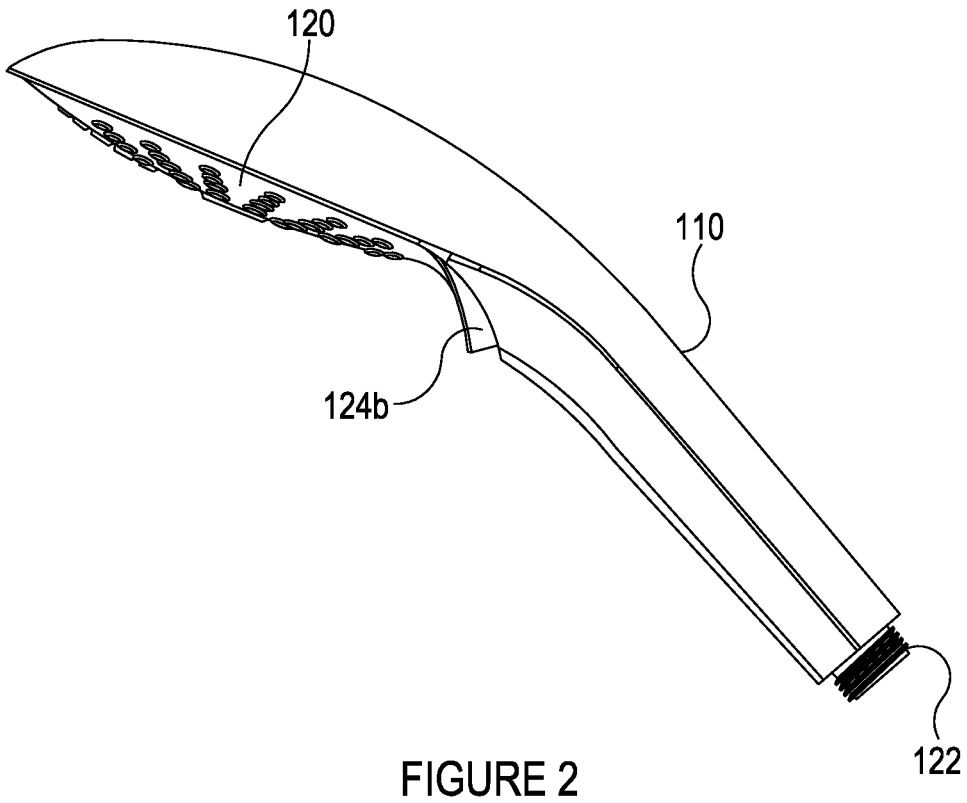
FIG. 2 shows a side view of the shower handset of FIG. 1.
Figure 3:
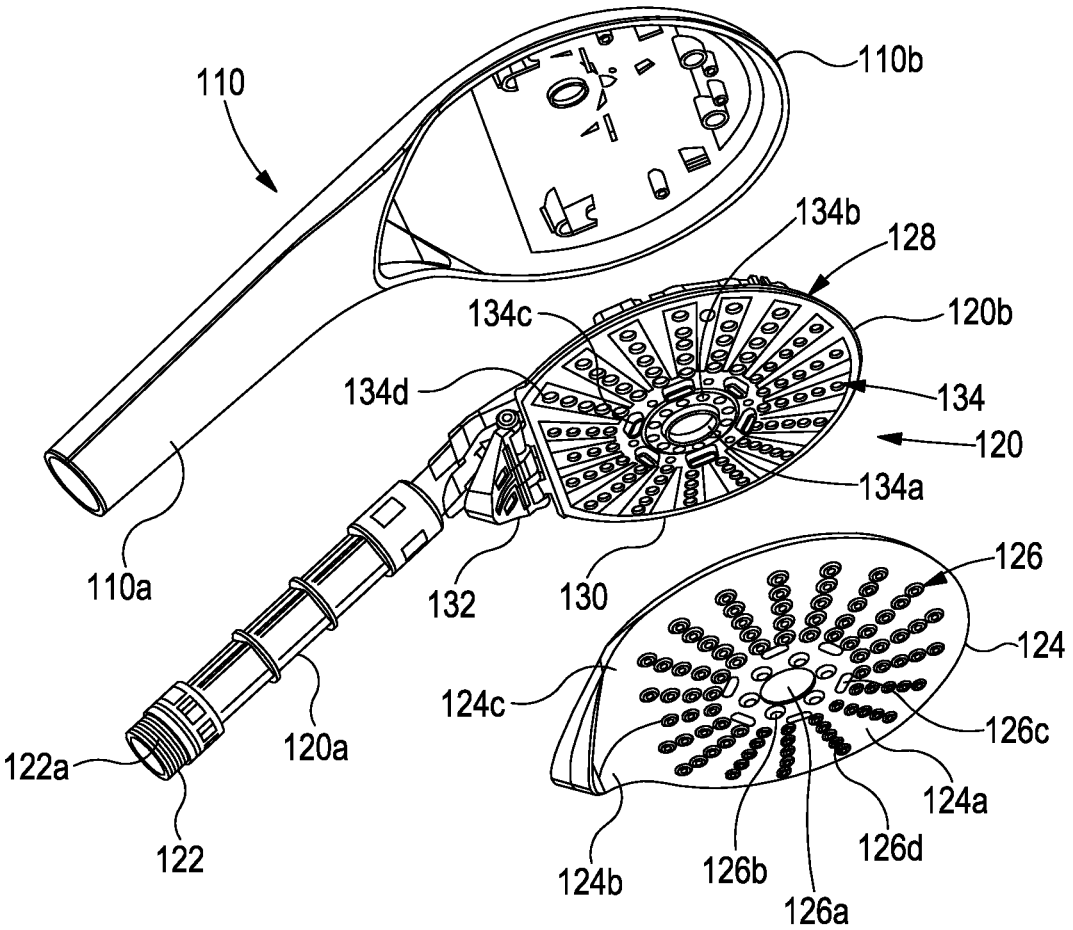
FIG. 3 shows an exploded view of the shower handset of FIGS. 1 and 2.

The actuator portion 124*b* overlies the switch member 132 and is configured to project from the body 110 in its inactive position as best shown in FIG. 2. in use the actuator portion 124*b* is depressible by a user from its inactive position to an active-position to operate the spray control mechanism via the switch member 132 to change the spray pattern. The switch member 132 may be biased by a spring (not shown) to return the actuator portion 124*b* to its inactive position when released by the user. Each depression of the actuator portion 124*b* changes the spray pattern.

The flow plate 130 may comprise channels (not shown) between the back of the flow plate 130 and the head portion 110*b* of the body 110 that direct flow of water to the holes 134 in the flow plate 130 and the spray control mechanism may comprise a diverter (not shown) operable by the switch member 132 to control the water flow to the channels to change the selected spray pattern or spray patterns in response to activation of the actuator portion 124*b*.

The spray plate 124 may be flexible. The spray plate 124 may comprise a unitary component. The apertured portion 124*a* and actuator portion 124*b* may be integral The spray plate 124 may be configured to allow the actuator portion 124*b* to be moved relative to the apertured portion 124*a*. The actuator portion 124*b* may be connected to the aperture portion 124*a* by an integral hinge portion 124*c* of the spray plate 124.

The flow plate 130 may be rigid. The flow plate 130 may be fixed relative to the bead portion 110*b* of the body 110. The apertured portion 124*a* of the spray plate 124 may be supported by the flow plate 130. The apertured portion 124*a* may be fixed relative to the head portion 110*b* of the body 110.

The invention is not limited to the embodiment described. The spray control mechanism responsive to depression of the actuator portion may be of any suitable construction. The spray plate may be provided with more than one actuator portion.

The invention claimed is:

1. A spray head for a shower comprising a spray plate having an apertured portion and an actuator portion, wherein the actuator portion of the spray plate is connected to the apertured portion of the spray plate by an integral hinge portion of the spray plate, the apertured portion having apertures therein and the actuator portion being configured to be depressed by a user to change a spray pattern provided by the apertures of the apertured portion; and a spray control mechanism comprising a flow plate and a switch member pivotally connected to the flow plate, wherein the spray plate overlies the flow plate and the switch member, wherein depression of the actuator portion operates the spray control mechanism via the switch member.

2. The spray head of claim 1, wherein the actuator portion is arranged to operate the spray control mechanism located behind the spray plate to control fluid flow to the apertured portion for changing the spray pattern.

3. The spray head of claim 1, wherein the flow plate is located behind the spray plate and has holes therein aligned with the apertures in the apertured portion of the spray plate.

4. The spray head of claim 1, wherein the spray control mechanism includes a diverter operable in response to depression of the actuator portion of the spray plate to change the spray pattern.

5. The spray head of claim 1, wherein the actuator portion is integral with the apertured portion of the spray plate, such that the spray plate is provided by a unitary component.

6. The spray head of claim 5, wherein the spray plate is made of a flexible material.

7. The spray head of claim 1, wherein the actuator portion is arranged to allow switching of the spray pattern each time the actuator portion is depressed.

8. The spray head of claim 1, wherein the flow plate is rigid.

9. The spray head of claim 1, wherein the switch member is biased, by a spring, to return the actuator portion to its inactive position.

10. The spray head of claim 1, wherein the spray plate and the flow plate are configured to confine fluid flow through the apertures such that fluid is prevented from leaking between the spray plate and the flow plate.

11. The spray head of claim 1, wherein the switch member is pivotally connected to the flow plate by a hinge.

12. A shower comprising the spray head of claim 1.

13. A method of adjusting the spray pattern of fluid from a spray head according to claim 1, the method comprising depressing the depressible actuator portion of the spray plate.

14. A spray head for a shower comprising:

a spray plate having an apertured portion and an actuator portion, the apertured portion having apertures therein and the actuator portion being configured to be depressed by a user to change a spray pattern provided by the apertures of the apertured portion; and a spray control mechanism comprising a flow plate and a switch member pivotally connected to the flow plate, wherein the spray plate overlies the flow plate and the switch member, wherein depression of the actuator portion operates the spray control mechanism via the switch member;

wherein the apertured portion of the spray plate is circular, and wherein the actuator portion of the spray plate is provided as a curved protrusion from a circumference of the aperture portion.

* * * * *